US007855700B2

(12) United States Patent
Kim et al.

(10) Patent No.: US 7,855,700 B2
(45) Date of Patent: Dec. 21, 2010

(54) ORGANIC LIGHT EMITTING DISPLAY

(75) Inventors: Yang Wan Kim, Seoul (KR); Choon Yul Oh, Gunpo-si (KR)

(73) Assignee: Samsung Mobile Display Co., Ltd., Gyeonggi-Do (KR)

( * ) Notice: Subject to any disclaimer, the term of this patent is extended or adjusted under 35 U.S.C. 154(b) by 784 days.

(21) Appl. No.: 11/390,589

(22) Filed: Mar. 27, 2006

(65) Prior Publication Data

US 2006/0262130 A1 Nov. 23, 2006

(30) Foreign Application Priority Data

Apr. 28, 2005 (KR) ..... 10-2005-0035764

(51) Int. Cl.
*G09G 3/30* (2006.01)

(52) U.S. Cl. ..... 345/77; 345/76; 345/44

(58) Field of Classification Search ..... 345/44–55, 345/76–81, 82, 83, 92, 94, 98, 99, 100, 206, 345/208; 313/503, 504
See application file for complete search history.

(56) References Cited

U.S. PATENT DOCUMENTS

| | | | | |
|---|---|---|---|---|
| 6,348,906 | B1 * | 2/2002 | Dawson et al. | 345/82 |
| 6,909,242 | B2 * | 6/2005 | Kimura | 315/169.3 |
| 6,924,784 | B1 * | 8/2005 | Yeo et al. | 345/98 |
| 2002/0011976 | A1 * | 1/2002 | Hashimoto | 345/76 |
| 2003/0057518 | A1 * | 3/2003 | Schaper et al. | 257/533 |
| 2003/0179164 | A1 * | 9/2003 | Shin et al. | 345/76 |
| 2003/0197665 | A1 | 10/2003 | Sung | |
| 2004/0041744 | A1 * | 3/2004 | Inoue et al. | 345/1.3 |
| 2004/0119075 | A1 * | 6/2004 | Murade | 257/72 |
| 2004/0125067 | A1 * | 7/2004 | Kim et al. | 345/98 |
| 2004/0140969 | A1 * | 7/2004 | Morita | 345/204 |
| 2004/0145547 | A1 * | 7/2004 | Oh | 345/76 |
| 2005/0007319 | A1 * | 1/2005 | Shin et al. | 345/76 |
| 2005/0017934 | A1 * | 1/2005 | Chung et al. | 345/82 |
| 2005/0030268 | A1 * | 2/2005 | Zhang et al. | 345/83 |
| 2005/0237273 | A1 * | 10/2005 | Ozawa et al. | 345/46 |

(Continued)

FOREIGN PATENT DOCUMENTS

KR 10-2005-0014124 A 2/2005

*Primary Examiner*—Amare Mengistu
*Assistant Examiner*—Dmitriy Bolotin
(74) *Attorney, Agent, or Firm*—Knobbe Martens Olson & Bear LLP

(57) ABSTRACT

Disclosed is an organic light emitting display that reduces the number of output lines and adjusts a white balance. A scan driver supplies scan signals to a plurality of scan lines. A data driver supplies data signals to a plurality of output lines. Demultiplexers are installed at the respective output lines, and supply the data signals to the plurality of data lines. Data capacitors are coupled with the data lines, and charge a voltage corresponding to the data signals. An image display device is coupled with the scan lines and the data lines, and includes red pixels having a red organic light emitting diode, green pixels having a green organic light emitting diode, and blue pixels having a blue organic light emitting diode. A first initialization power supply supplies a first voltage to the red pixels. A second initialization power supply supplies a second voltage to the green pixels. A third initialization power supply supplies a third voltage to the blue pixels. Voltages of the first, second, and third initialization power supplies are differently set, respectively.

20 Claims, 7 Drawing Sheets

U.S. PATENT DOCUMENTS

2006/0044235 A1* 3/2006 Lee et al. ..... 345/82
2006/0071884 A1* 4/2006 Kim ..... 345/76
2006/0107146 A1* 5/2006 Kim et al. ..... 714/727
2006/0151745 A1* 7/2006 Kim et al. ..... 252/301.16
2006/0267885 A1* 11/2006 Kwak et al. ..... 345/76
2007/0040770 A1* 2/2007 Kim ..... 345/76
2008/0036704 A1* 2/2008 Kim et al. ..... 345/76

* cited by examiner

ORGANIC LIGHT EMITTING DISPLAY

CROSS-REFERENCE TO RELATED APPLICATIONS

This application claims the benefit of Korean Patent Application No. 10-2005-35764, filed on Apr. 28, 2005, in the Korean Intellectual Property Office, the disclosure of which is incorporated herein by reference.

BACKGROUND OF THE INVENTION

1. Field of the Invention

The present invention relates to an organic light emitting display, and more particularly, to an organic light emitting display which reduces the number of output lines and enhances a white balance.

2. Description of the Related Technology

Recently, various flat panel displays have been developed as substitutes for a Cathode Ray Tube (CRT) display which is relatively heavy and bulky. Examples of flat panel displays include a liquid crystal display (LCD), a field emission display (FED), a plasma display panel (PDP), an organic light emitting display, and so forth.

An organic light emitting display, among the flat panel displays, displays an image using an organic light emitting diode that generates light by the recombination of electrons and holes. Such an organic light emitting display has advantages of a high response speed and a low operational power consumption. The organic light emitting display can be referred to as an organic electroluminescent display.

FIG. 1 illustrates a conventional organic light emitting display. Referring to FIG. 1, the conventional organic light emitting display includes a pixel portion 30, a scan driver 10, a data driver 20, and a timing controller 50. The pixel portion 30 includes a plurality of pixels 40 coupled with scan lines S1 to Sn and data lines D1 to Dm. The scan driver 10 drives the scan lines S1 to Sn. The data driver 20 drives the data lines D1 to Dm. The timing controller 50 controls the scan driver 10 and the data driver 20.

The scan driver 10 receives a scan drive control signal SCS from the timing controller 50. Upon the receipt of the scan drive control signal SCS, the scan driver generates a scan signal, and sequentially provides the scan signal to the scan lines S1 to Sn.

The data driver 20 receives a data drive control signal DCS from the timing controller 50. Upon the receipt of the data drive control signal DCS, the data driver 20 generates a data signal of a predetermined voltage level, and provides the data signal to the data lines D1 to Dm in synchronism with the scan signal.

The timing controller 50 generates the data drive control signal DCS and the scan drive control signal SCS according to externally supplied synchronous signals. The timing controller 50 then transmits the data drive control signal DCS to the data driver 20, and the scan drive control signal SCS to the scan driver 10. Furthermore, the timing controller 50 provides externally supplied data denoted as "Data" to the data driver 20.

The pixel portion 30 receives a first power supply ELVDD and a second power supply ELVSS from external power sources (not shown). It then provides the power supplies to respective pixels 40. Upon receiving the first and second power supplies ELVDD and ELVSS, each of the pixels 40 controls the amount of current flowing from the first power supply ELVDD through an organic light emitting diode into the second power supply ELVSS according to the data signal, thus generating light corresponding to the data signal. Furthermore, light emitting times of the pixels 40 are controlled by the light emitting control signal.

In the conventional organic light emitting display described above, each of the pixels 40 is positioned in a grid region defined by two horizontally adjacent scan lines and two vertically adjacent data lines. Here, the data driver 20 includes m number of output lines for supplying data signals to m number of data lines D1 to Dm. That is, in the conventional organic light emitting display, the data driver 20 includes the same number of output lines as the data lines D1 to Dm. Accordingly, a plurality of data driving circuits should be provided in the data driver 20 in order to have m output lines therein, which increases the manufacturing cost. In addition, as the resolution and size of the image display device 30 are increased, the number of pixels also increases. The data driver 20 should have more output lines to provide signals to the additional pixels. This requires providing more data driving circuits in the data driver, which further increases the manufacturing cost.

SUMMARY OF CERTAIN INVENTIVE ASPECTS

One aspect of the invention provides an organic light emitting display that can reduce the number of output lines. The organic light emitting display comprises: a scan driver connected to a plurality of scan lines; a data driver connected to a plurality of first data lines; a plurality of sets of second data lines; a plurality of demultiplexers, each of the demultiplexers being connected at its input to a respective one of the first data lines and at its outputs to a respective one set of the second data lines; an image display device connected to the scan lines and the second data lines, the image display device having a plurality of pixels; and an initialization power supply connected to the image display device.

The display may further comprise a plurality of data capacitors, each of the data capacitors being coupled with a respective one of the second data lines. The image display device may comprise red pixels, green pixels, and blue pixels. The initialization power supply may comprise: a first initialization power supply connected to the red pixels; a second initialization power supply connected to the green pixels; and a third initialization power supply connected to the blue pixels, wherein the voltages supplied by the first, second, and third initialization power supplies are different from one another.

In the organic light emitting display, the voltage of the first initialization power supply may be lower than that of the second initialization power supply. The voltage of the first initialization power supply may be higher than that of the third initialization power supply. Each of the pixels may comprise: an organic light emitting diode; a second transistor coupled between one of the second data lines and one of the scan lines; a storage capacitor for charging a voltage corresponding to a data signal supplied from the one of the second data lines; a first transistor for supplying an electric current corresponding to the voltage charged in the storage capacitor to the organic light emitting diode; a third transistor for causing the first transistor to be diode-connected; and a fourth transistor coupled with the initialization power supply.

The organic light emitting display may further comprise at least one fifth transistor coupled with a light emitting control line for controlling a supply time of an electric current flowing from the first transistor to the organic light emitting diode. The scan driver may supply a scan signal during a first period that is a part of one horizontal period. The data driver may supply a plurality of data signals to the first data line during a second period which does not overlap with the first period of the one horizontal period. The demultiplexer may comprise a plurality of transistors, each of the transistors being coupled with a respective one of the second data lines. The plurality of transistors may be sequentially turned-on during the second period to supply the data signal to the data capacitors. The voltage stored in the data capacitors may be supplied to the red, green, and blue pixels during the first period. The image display device may comprise pixels of different colors and the pixels of different colors may be provided with initialization power supplies of different voltage levels.

Another aspect of the invention provides an organic light emitting display comprising: means for providing scan signals to a plurality of scan lines; means for providing data signals to a plurality of first data lines; a plurality of sets of second data lines; a plurality of means for receiving a data signal from a respective one of the first data lines and outputting data signals to a respective one set of the second data lines; means for displaying an image according to the scan signals from the scan lines and the data signals from the second data lines; and means for supplying power to the displaying means.

Yet another aspect of the invention provides an organic light emitting display comprising a scan driver for supplying a scan signal to a plurality of scan lines; a data driver for supplying a data signal to a plurality of output lines; demultiplexers installed at the respective output lines, for supplying the data signal to the plurality of data lines; data capacitors coupled with the data lines for charging a voltage corresponding to the data signal; an image display device coupled with the scan lines and the data lines; a first initialization power supply for supplying a first voltage to the red pixels; a second initialization power supply for supplying a second voltage to the green pixels; a third initialization power supply for supplying a third voltage to the blue pixels. The image display device includes red pixels having a red organic light emitting diode, green pixels having a green organic light emitting diode, and blue pixels having a blue organic light emitting diode. The voltages of the first, second, and third initialization power supplies may be differently set, respectively.

Another aspect of the invention provides an organic light emitting display that can enhance a white balance. In the organic light emitting display, the first initialization power supply may have a voltage lower than that of the second initialization power supply. The voltage of the first initialization power supply may be set higher than that of the third initialization power supply. Each of the pixels includes: one of a red organic light emitting diode, a green organic light emitting diode, and a blue organic light emitting diode; a second transistor coupled between the data lines and the scan lines; a storage capacitor for charging a voltage corresponding to the data signal; a first transistor for supplying an electric current corresponding to the voltage charged in the storage capacitor to the organic light emitting diode; a third transistor for causing the first transistor to be diode-connected; and a fourth transistor coupled with one of the first, second, and third initialization power supplies.

BRIEF DESCRIPTION OF THE DRAWINGS

Aspects and advantages of the invention will become apparent and more readily appreciated from the following description, taken in conjunction with the accompanying drawings.

DETAILED DESCRIPTION OF CERTAIN INVENTIVE EMBODIMENTS

Figure 1:
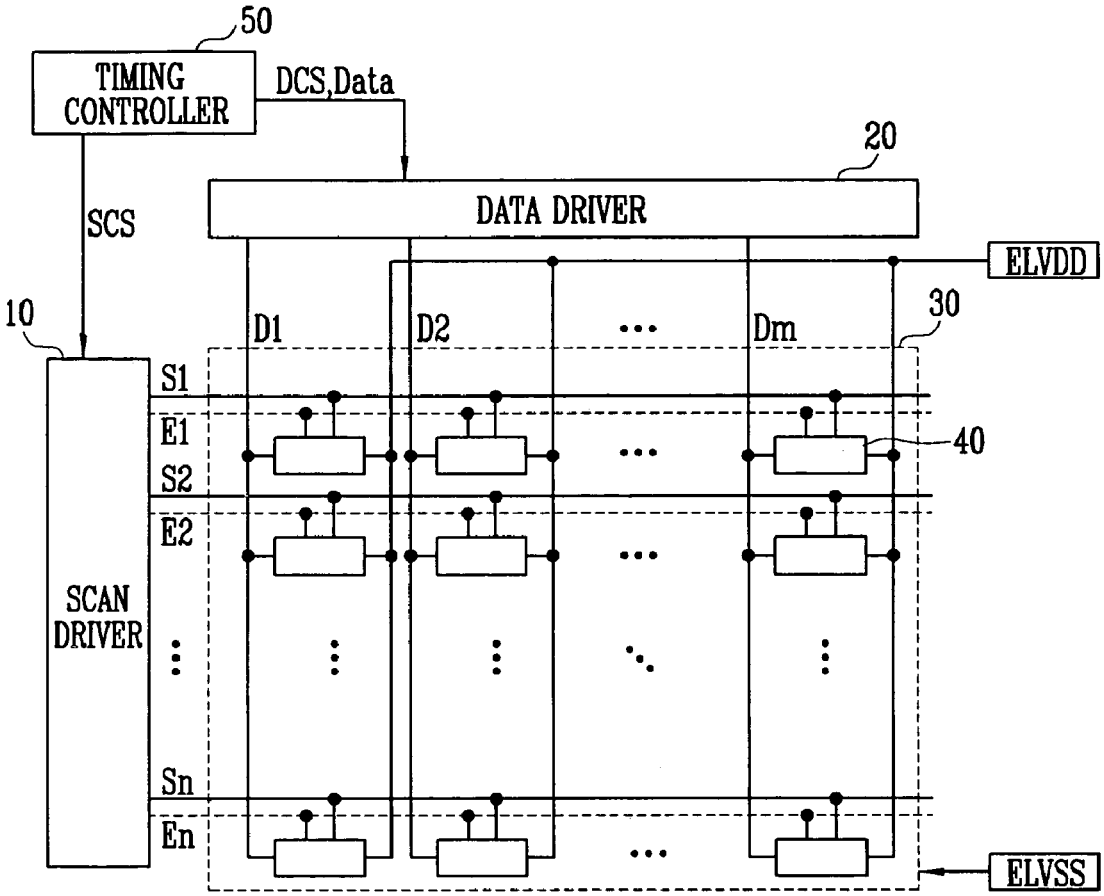
FIG. 1 (PRIOR ART)
FIG. 1 is a schematic view showing a conventional organic light emitting display.

Organic light emitting displays according to embodiments of the invention will be described in detail with reference to the accompanying drawings. In the drawings, like reference numerals indicate identical or functionally similar elements.

Figure 2:
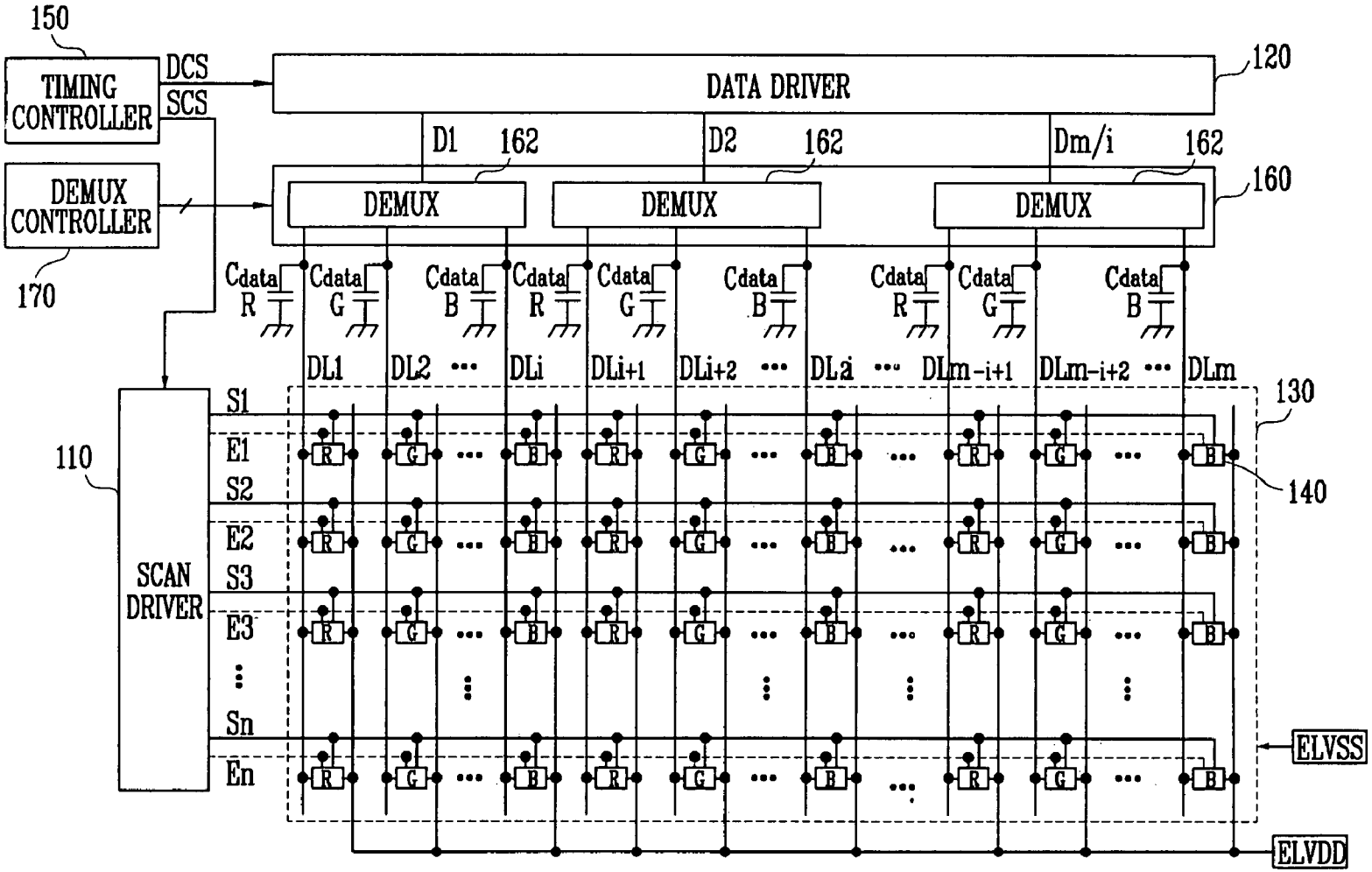
FIG. 2 is a schematic view showing an organic light emitting display according to an embodiment of the invention.

FIG. 2 is a schematic view showing an organic light emitting display according to an embodiment of the invention.

With reference to FIG. 2, the organic light emitting display according to an embodiment comprises a scan driver 110, a data driver 120, an image display device 130, a timing controller 150, a demultiplexer block 160, a demultiplexer controller 170, data capacitors Cdata, first data lines D1 to Dm/i, second data lines DL1 to DLm, scan lines S1 to Sn, and light emitting control lines E1 to En.

The image display device 130 includes a plurality of pixels positioned in areas partitioned by the scan lines S1 to Sn and the second data lines DL1 to DLm. Each of the pixels 140 generates light corresponding to a data signal supplied from a respective one of the second data lines DL1 to DLm. Each of the pixels 140 comprises one of a red pixel R for generating red light, a green pixel G for generating green light, and a blue pixel B for generating blue light. In one embodiment, R, G, and B pixels 140 are arranged in a repeating order as illustrated in FIG. 2.

Figure 4:
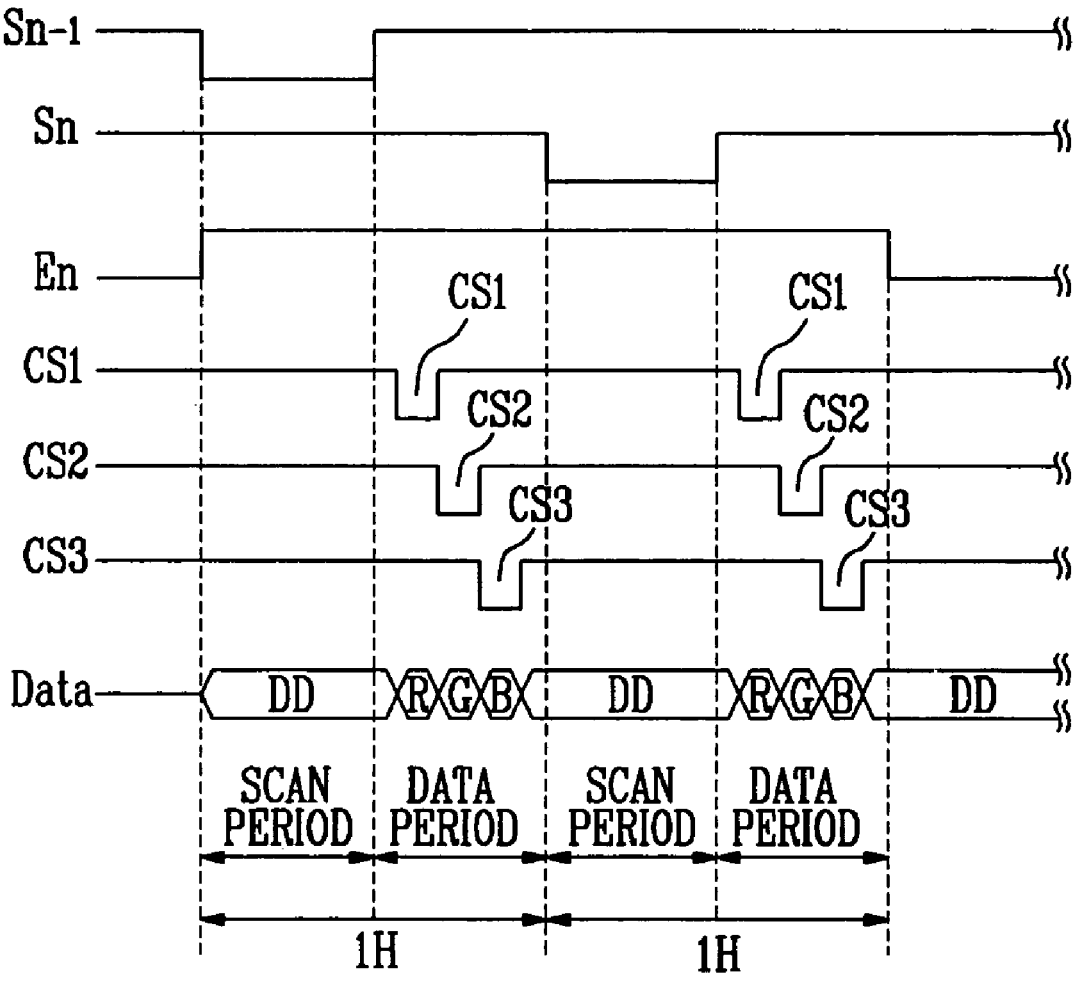
FIG. 4 illustrates waveforms of signals for driving an organic light emitting display according to an embodiment of the invention.

The scan driver 110 generates scan signals in response to scan drive control signals SCS from the timing controller 150, and sequentially provides the scan signals to the scan lines S1 to Sn. In this embodiment, the scan driver 110 supplies a scan signal only during a predetermined period of one horizontal period 1H as shown in FIG. 4.

In one embodiment, one horizontal period 1H includes a scan period (a first period) and a data period (a second period). The scan driver 110 supplies a scan signal to one of the scan lines S1 to Sn during the scan period of one horizontal period 1H, but does not supply the scan signal during the data period. In addition, the scan driver 110 generates light emitting control signals in response to scan drive control signals SCS from the timing controller 150, and sequentially provides the light emitting control signals to the light emitting control lines E1 to En.

The data driver 120 generates data signals in response to data drive control signals DCS from the timing controller 150, and provides the data signals to first data lines D1 to Dm/i. The data driver 120 sequentially provides i number of data signals to the first data lines D1 to Dm/i. "i" denotes a natural number equal to or greater than 2. Each of the first data lines D1 to Dm/i is connected to a respective one of the output lines (not shown) of the data driver 120.

In one embodiment, the data driver 120 sequentially provides i number of data signals R, G, and B during the data period of one horizontal period 1H. Because the data signals R, G, and B are provided only during the data period, the data signals R, G, and B do not overlap with the scan signal. The data driver 120 may also provide dummy data DD during the scan period of one horizontal period 1H. The dummy data are data that do not contribute to the brightness of a displayed image. Since the dummy data do not contribute to the brightness, they may be omitted.

The timing controller 150 generates data drive control signals DCS and scan drive control signals SCS according to externally supplied synchronous signals. The controller 150 then provides the scan drive control signals SCS and the data drive control signals DCS to the scan driver 110 and the data driver 120, respectively.

The demultiplexer block 160 includes m/i number of demultiplexers 162. "m" denotes the number of the second data lines DL1 to DLm. "i" denotes the number of the outputs of one demultiplexer 162. The demultiplexer block 160 includes the same number of demultiplexers as the first data lines D1 to Dm/i. Each demultiplexer 162 is connected at its input to a respective one of the first data lines D1 to Dm/i. In addition, each demultiplexer 162 is connected at its outputs to respective i number of the second data lines DL. Each demultiplexer 162 provides i number of data signals to the respective i number of the second data lines DL during a data period.

Since one data signal supplied from one first data line D is provided to i number of the second data lines DL, the number of the output lines of the data driver 120 can be reduced to a great extent. For example, assuming that 'i' is 3, the number of the output lines of the data driver 120 is reduced to ⅓ of that of the conventional organic light emitting display. Accordingly, the number of integrated circuits included in the data driver 120 can be reduced. The manufacturing cost can therefore be reduced.

The demultiplexer controller 170 provides i number of control signals to the demultiplexers 162 during the data period of one horizontal period so that i number of data signals supplied to a first data line D are divided and provided to respective i number of second data lines DL. The i number of control signals are sequentially provided to the demultiplexer 162 to avoid overlapping with each other as shown in FIG. 4. In FIG. 4, three control signals CS1-CS3 are sequentially provided during a data period. In FIG. 2, the demultiplexer controller 170 is a separate component from the timing controller 150. In another embodiment, the demultiplexer controller 170 may be integrated with the timing controller 150.

Each of the second data lines DL is provided with a respective data capacitor Cdata. A data capacitor Cdata temporarily stores a data signal supplied to a second data line DL and supplies the stored data signal to a pixel 140. In this embodiment, the data capacitor Cdata comprises a parasitic capacitor equivalently formed at the second data line DL. Since the parasitic capacitor is set to have a capacity larger than that of a storage capacitor C included in a pixel 140 of FIG. 5, it can stably store the data signal.

Figure 3:
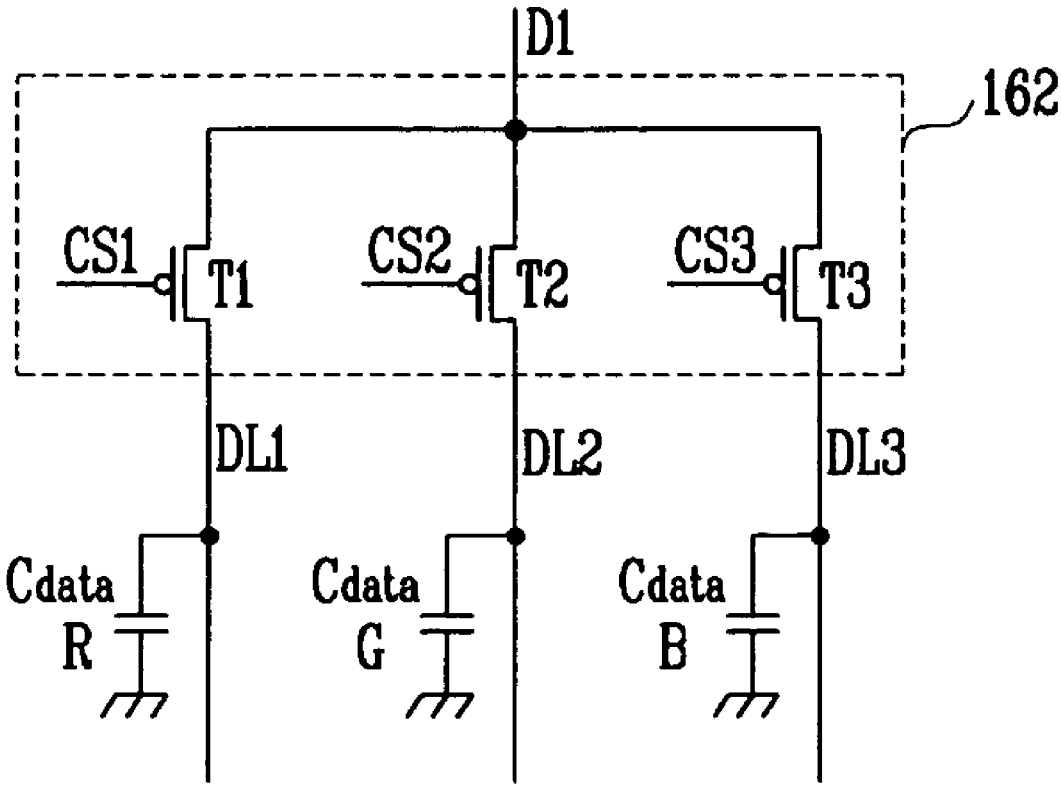
FIG. 3 is a circuit diagram of one embodiment of the demultiplexer of the organic light emitting display of FIG. 2.

FIG. 3 is a schematic circuit diagram showing the demultiplexer 162 shown in FIG. 2. In this embodiment, i, the number of the outputs of the demultiplexer 162, is 3. Further, it is assumed that the demultiplexer 162 of FIG. 3 is connected to a first data line D1 which is located first from the left side in FIG. 2.

Referring to FIG. 3, each of the demultiplexers 162 includes a first switch T1, a second switch T2, and a third switch T3. In this embodiment, by way of example, the switches comprise a transistor, more particularly, a MOSFET. However, it should be noted that other types of switches can be used. The first switch T1 is connected between the first data line D1 and a second data line DL1. When a first control signal CS1 is supplied from the demultiplexer controller 170 to the first switch T1, the first switch T1 is turned-on. This allows a data signal to flow from the first data line D1 to the second data line DL1. The data signal provided to the second data line DL1 is temporarily stored in a first data capacitor CdataR connected to the second data line DL1.

The second switch T2 is connected between the first data line D1 and a second data line DL2 which is located second from the left in FIG. 3. When a second control signal CS2 is supplied from the demuliplexer controller 170, the second switch T2 is turned-on so that the data signal flows from the first data line D1 to the second data line DL2. The data signal provided to the second data line DL2 is temporarily stored in a second data capacitor CdataG connected to the second data line DL2.

Similarly, the third switch T3 is connected between the first data line D1 and a second data line DL3 which is located third from the left in FIG. 3. When a third control signal CS3 is supplied from the demuliplexer controller 170, the third switch T3 is turned-on so that the data signal flows from the first data line D1 to the second data line DL3. The data signal provided to the second data line DL3 is temporarily stored in a third data capacitor CdataB connected to the second data line DL3. The operation of the demultiplexer 162 will be explained below in detail in connection with a pixel 140.

Figure 5:
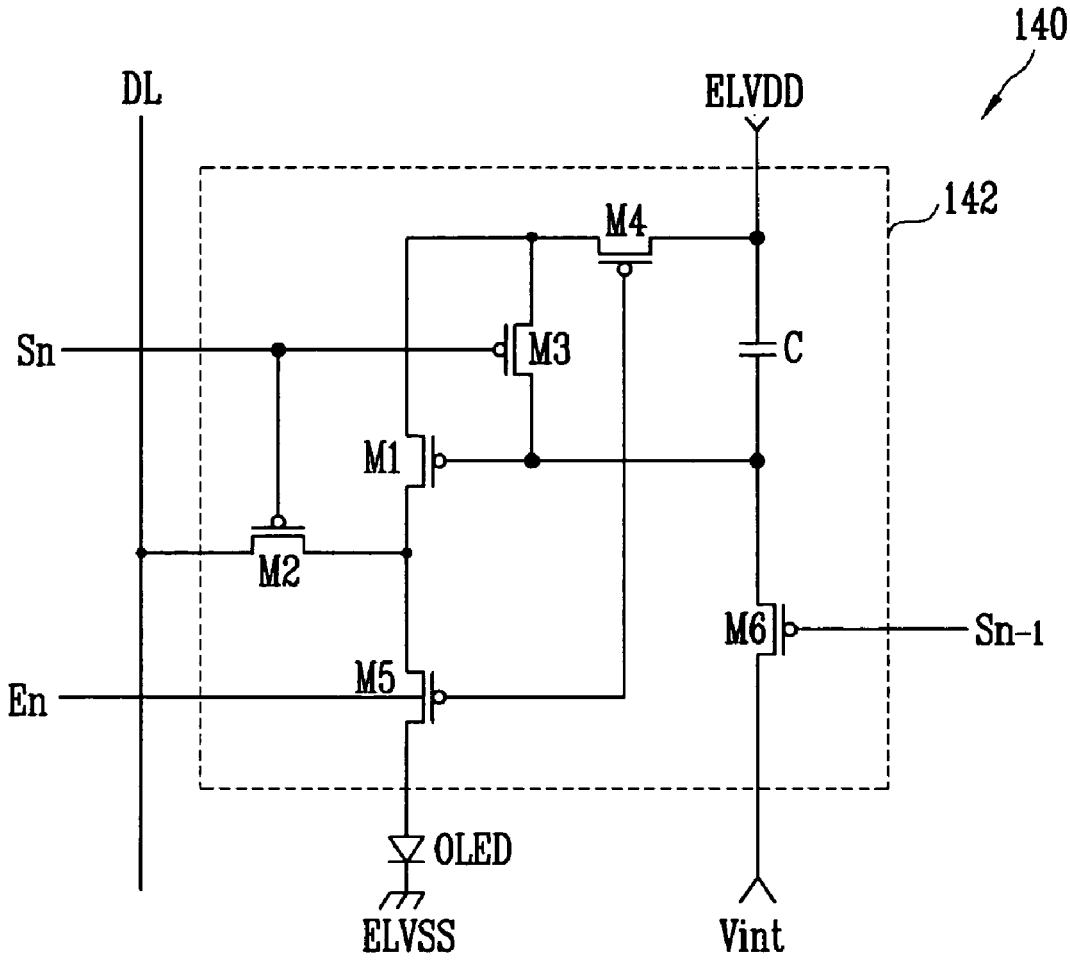
FIG. 5 is a circuit diagram of one embodiment of the pixel of the organic light emitting display of FIG. 2.

FIG. 5 is a circuit diagram showing one embodiment of the pixel of the organic light emitting display of FIG. 2. The structure of the pixel in FIG. 5 is provided by way of example, and can be varied in connection with an initialization power supply.

Referring to FIG. 5, each of pixels 140 according to one embodiment includes an organic light emitting diode OLED and a pixel circuit 142. The pixel circuit 142 is connected to a second data line DL, scan lines Sn and Sn−1, a light emitting control line En, a first power supply ELVDD, an initialization power supply Vint, and the organic light emitting diode OLED.

The anode electrode of the organic light emitting diode OLED is connected to the pixel circuit 142, and the cathode electrode thereof is connected to a second power supply ELVSS. The voltage of the second power supply ELVSS is set lower than that of the first power supply ELVDD. For example, a ground voltage is set as the voltage of the second power supply ELVSS. The organic light emitting diode OLED generates one of red, green, and blue lights according to a current supplied from the pixel circuit 142. The organic light emitting diode OLED comprises an organic material containing a fluorescent and/or a phosphorescent materials to generate a light.

According to one embodiment, the pixel circuit 142 includes a storage capacitor C, a first transistor M1, a second transistor M2, a third transistor M3, a fourth transistor M4, a fifth transistor M5, and a sixth transistor M6. The storage capacitor C and the sixth transistor M6 are connected between the first power supply ELVDD and the initialization power supply Vint. The fourth transistor M4, the first transistor M1, and the fifth transistor M5 are connected between the first power supply ELVDD and the organic light emitting diode OLED in series. The third transistor M3 is connected between a gate electrode and a first electrode of the first transistor M1. The second transistor M2 is connected between the second data line DL and a second electrode of the first transistor M1. In this embodiment, the first electrode of the first transistor M1 comprises one of its source and drain electrodes. The second electrode comprises the other of the two. For example, when the first electrode is the source electrode, the second electrode is the drain electrode. In this embodiment as shown in FIG. 5, the first to sixth transistors M1 to M6 are P-type MOSFETs. In other embodiments, N-type MOSFETs or other types of transistors can be used. When the first to sixth transistors M1 to M6 are N-type MOSFETs, the polarity of the driving signal is inverted.

The first electrode of the first transistor M1 is coupled with the first power supply ELVDD through the fourth transistor M4, and the second electrode thereof is coupled with the organic light emitting diode through the fifth transistor M5. Further, the gate electrode of the first transistor M1 is coupled with a storage capacitor C. The first transistor M1 provides an electric current corresponding to a voltage charged in the storage capacitor C to the organic light emitting diode OLED.

A first electrode of the transistor M3 is connected to the first electrode of the first transistor M1, and a second electrode thereof is connected to the gate electrode of the first transistor M1. In addition, a gate electrode of the third transistor M3 is connected to an n-th scan line Sn. When a scan signal is supplied to the n-th scan line Sn, the third transistor M3 is turned-on, thereby causing the first transistor M1 to be diode-connected. That is, when the third transistor M3 is turned-on, the first transistor M1 is diode-connected.

A first electrode of the second transistor M2 is coupled with the second data line DL, and a second electrode thereof is coupled with the second electrode of the first transistor M1. In addition, a gate electrode of the second transistor M2 is coupled with the n-th scan line Sn. When a scan signal is provided to the n-th scan line Sn, the second transistor M2 is turned-on, thereby providing a data signal supplied from the second data line DL to the second electrode of the first transistor M1.

A first electrode of the fourth transistor M4 is connected to the first power supply ELVDD, and a second electrode thereof is connected to the first electrode of the first transistor M1. A gate electrode of the fourth transistor M4 is connected to a light emitting control line En. When the light emitting control signal is not supplied, the fourth transistor M4 is turned-on, thereby electrically connecting the first transistor M1 to the first power supply ELVDD.

A first electrode of the fifth transistor M5 is coupled with the second electrode of the first transistor M1, and a second electrode thereof is coupled with the organic light emitting diode OLED. In addition, a gate electrode of the fifth transistor M5 is coupled with the light emitting control line En. When the light emitting control is not supplied, the fifth transistor M5 is turned-on, thereby causing the first transistor M1 to be electrically connected to the organic light emitting diode OLED.

A first electrode of the sixth transistor M6 is connected to the initialization power supply Vint, and a second electrode thereof is connected to the storage capacitor C and the gate electrode of the first transistor M1. Furthermore, a gate electrode of the sixth transistor M6 is connected to an (n−1)th scan line Sn−1. When a scan signal is provided to the (n−1)th scan line Sn−1, the sixth transistor M6 is turned-on, thereby initializing the storage capacitor C and the gate electrode of the first transistor M1. In order to allow this operation, the voltage value of the initialization power supply Vint is set lower than that of the data signal.

Figure 6:
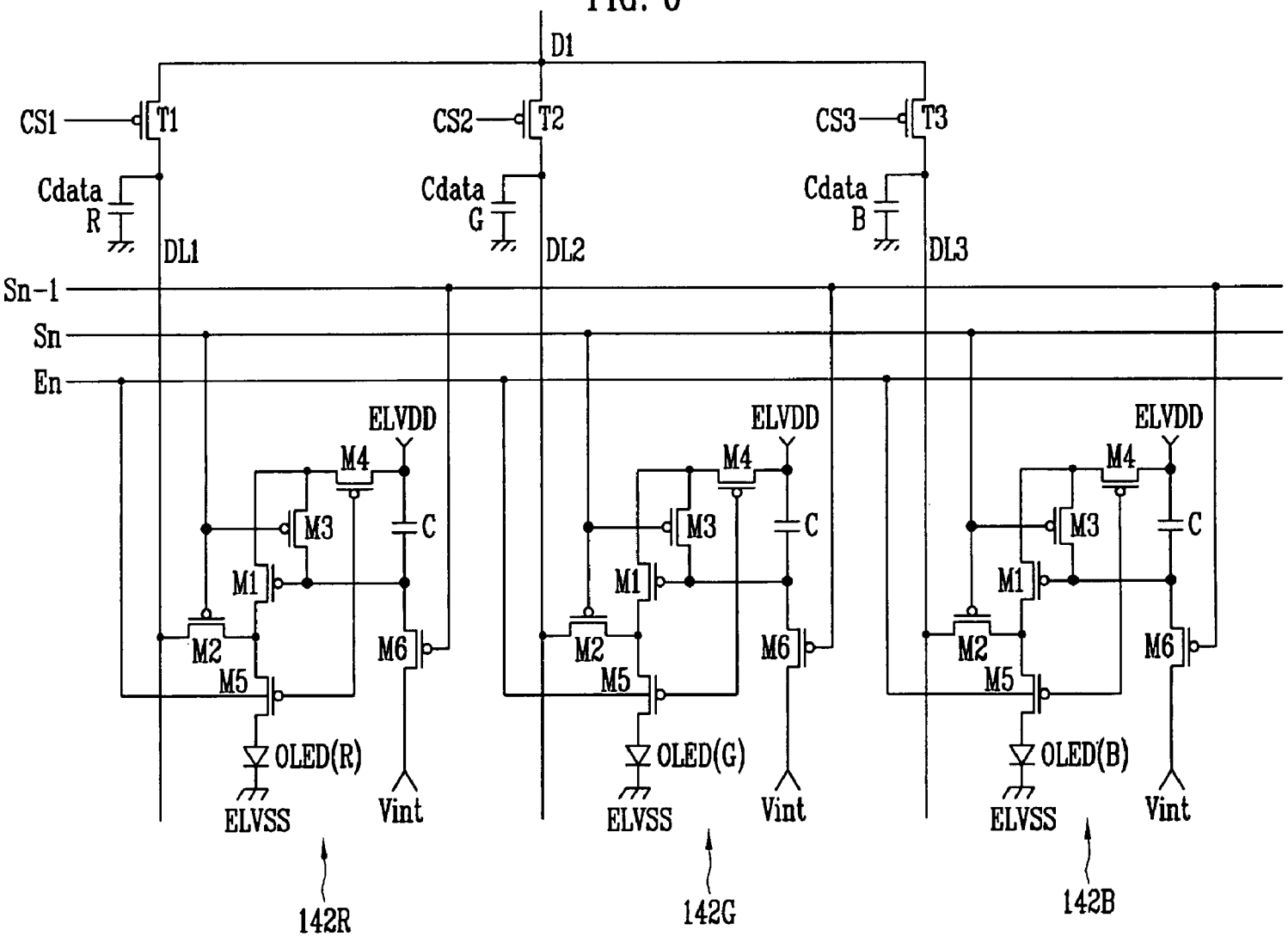
FIG. 6 is a circuit diagram illustrating a combination of the demultiplexer shown in FIG. 3 and the pixel shown in FIG. 5.

FIG. 6 is a circuit diagram showing a combined structure of the demuliplexer of FIG. 3 and the pixel of FIG. 5. In this embodiment, a red, a green, and a blue pixels, 142R, 142G, and 142B are coupled with one demultiplexer. Here, "i," the number of the outputs of the demultiplexer, is 3.

The operation of one embodiment will now be explained in detail in reference to FIGS. 4 and 6. First, during the scan period of one horizontal period 1H, a scan signal is supplied to the (n−1)th scan line Sn−1. When the scan signal is supplied to the (n−1)th scan line Sn−1, the sixth transistors M6 included in the pixels 142R, 142G, and 142B are turned-on. When the sixth transistors M6 are turned-on, the storage capacitors C and the gate electrodes of the first transistors M1 are electrically coupled with the initialization power supply Vint. Then, the voltage of the initialization power supply Vint is provided to the storage capacitors C and the gate electrodes of the first transistors M1 of the pixels 142R, 142G, and 142B, thereby initializing the pixels 142R, 142G, and 142B. While the scan signal is provided to the (n−1)th scan line Sn−1, the second transistors M2 connected to the n-th scan line Sn are kept turned-off.

Next, during the data period of one horizontal period 1H, the first to third control signals CS1 to CS3 are sequentially supplied. In response to these control signals, the first, the second, and the third switches T1, T2, and T3 are sequentially turned-on. When the first switch T1 is turned-on according to the first control signal CS1, a data signal supplied from the first data line D1 is provided to the second data line DL1 located first from the left in FIG. 6. A voltage corresponding to the data signal provided to the second data line DL1 is then charged in the first data capacitor CdataR.

When the second switch T2 is turned-on according to the second control signal CS2, the data signal supplied from the first data line D1 is provided to the second data line DL2 located second from the left in FIG. 6. A voltage corresponding to the data signal supplied to the second data line DL2 is provided to the second data capacitor CdataG. Similarly, when the third switch T3 is turned-on according to the third control signal CS3, the data signal supplied from the first data line D1 is provided to the second data line DL3 located third from the left in FIG. 6. A voltage corresponding to the data signal supplied to the second data line DL3 is provided to the third data capacitor CdataB. On the other hand, a scan control signal is not supplied during the data period. Thus, the data signal is not provided to the pixels 142R, 142G, and 142B through the switches T1, T2, and T3.

Next, during a scan period subsequent to the data period described above, a scan signal is supplied to the n-th scan line Sn. When the scan signal is supplied to the n-th scan line Sn, the second transistors M2 and the third transistors M3 in the pixels 142R, 142G, and 142B are turned on. When these transistors are turned on, voltages stored in the first, the second, and the third capacitors CdataR, CdataG, and CdataB are applied to the pixels 142R, 142G, and 142B.

In this embodiment, because the gate voltages of the first transistors M1 in the pixels 142R, 142G, and 142B have been initialized by the initialization power supply Vint (i.e., Vint has been set lower than a voltage of the data signal), the first transistors M1 are turned on. When the first transistors M1 are turned on, data signals are provided to one terminal of the storage capacitors C via the first transistors M1 and the third transistors M3. At this time, voltages corresponding to the data signals are charged in the storage capacitors C included in the pixels 142R, 142G, and 142B.

In addition to the voltage corresponding to the data signals, a voltage corresponding to a threshold voltage of the first transistors M1 is further charged in the storage capacitors C. Next, when a light emitting control signal is not supplied to a light emitting control line En, the fourth and fifth transistors M4 and M5 are turned on so that electric currents corresponding to the voltages charged in the storage capacitors C flow to the organic light emitting diodes OLED (R), OLED (G), and OLED (B), thereby generating red, green, and blue lights of a predetermined brightness.

The above-described embodiment is advantageous in that the number of the output lines of the data driver 120 can be reduced by using the demultiplexers 162. The demultiplexers provide a data signal supplied from a first data line D1 to respective i number of the second data lines DL. Further, the organic light emitting display according to the embodiment simultaneously provides the voltages stored in the data capacitors Cdata to the pixels. In other words, it provides the data signals simultaneously to the pixels, and therefore displays an image of uniform brightness.

Another aspect of the invention will now be described below with respect to white balancing. Even if an identical data signal is applied to an organic light emitting diode (OLED), the OLED may generate light of different brightness due to differences in material characteristics. When a data signal is applied to an organic light emitting display, light emission efficiencies are in the decreasing order of a green OLED, a red OLED, and a blue OLED as shown in Equation 1.

$$G>R>B \tag{1}$$

A green OLED has a better light emission efficiency than a red OLED. A red OLED has a better light emission efficiency than a blue OLED.

When OLEDs shows different light emission efficiencies, a white balance is not satisfied. Therefore, an image of desired colors cannot be displayed. In order to solve this problem, the voltage levels of initialization power supplies Vint may be set differently for a red pixel 142R, a green pixel 142G, and a blue pixel 142B.

Particularly, a voltage applied to the gate electrode of the first transistor M1 included in each pixel is set according to the following Equation 2.

$$VG=(Cdata\times Vdata+C\times Vint)/(Cdata+C) \tag{2}$$

In Equation 2, VG denotes a gate voltage of the first transistor M1. Vdata represents a voltage value corresponding to the data signal stored in the data capacitor Cdata. Vint is the voltage value of the initialization power supply. Cdata and C denote the capacitances of the data capacitor and the storage capacitor, respectively.

Referring to Equation 2, the higher the voltage value of the initialization power supply Vint is, the higher the voltage VG supplied to the gate electrode of the first transistor M1 is set. In such a case, when a higher voltage is applied to the gate electrode of the first transistor M1, a voltage to be charged in the storage capacitor C is set to be low, whereby an electric current supplied to the organic light emitting diode OLED is set to be low. Therefore, by setting the voltage values of the initialization power supplies Vint differently for the red pixel 142R, the green pixel 142G, and the blue pixel 142B, white balancing can be accomplished.

Figure 7:
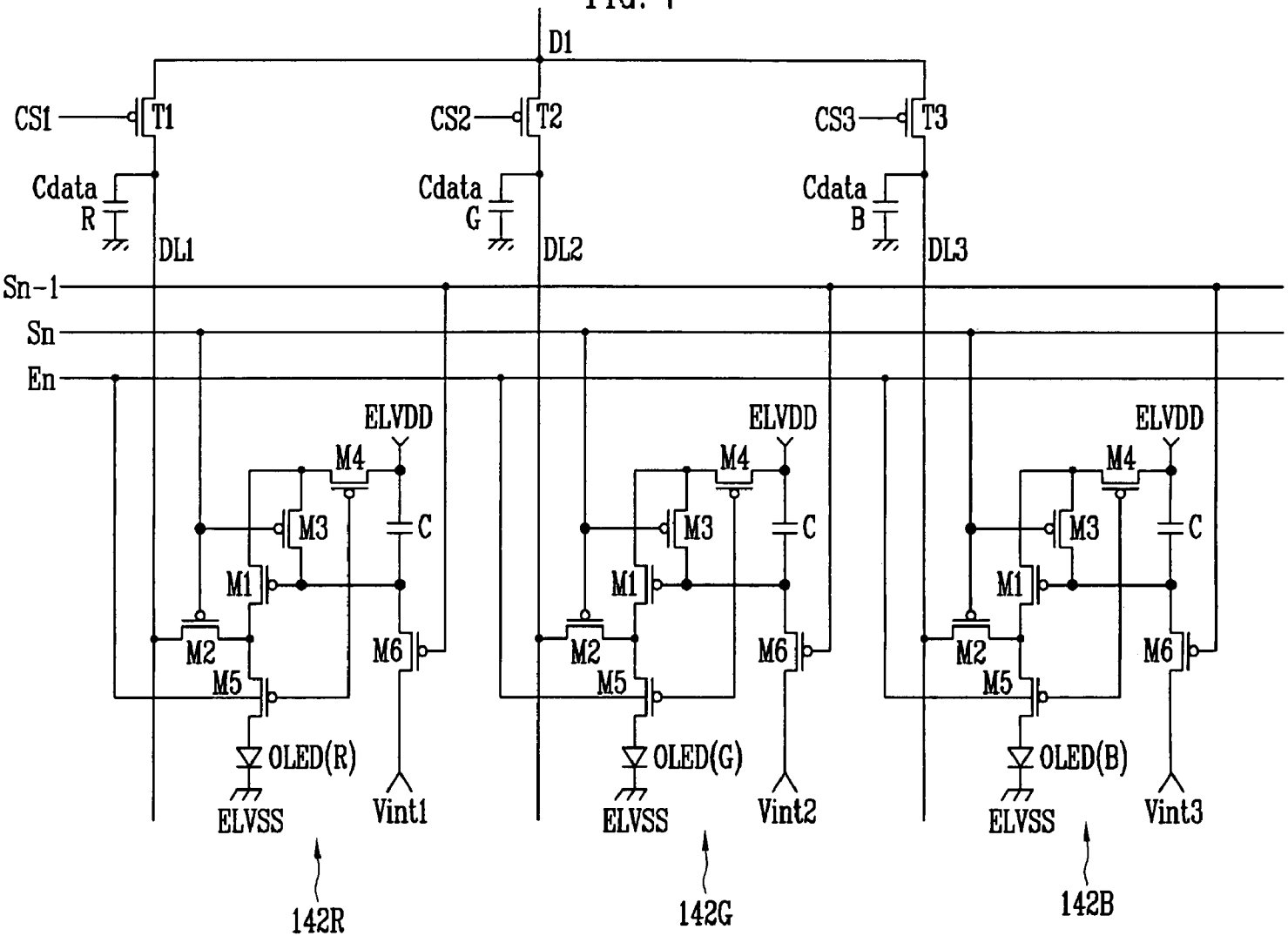
FIG. 7 is a circuit diagram illustrating a combination of the demultiplexer of FIG. 3 and the pixel of FIG. 5 in which the voltage values of initialization power supplies are set to adjust a white balance.

FIG. 7 illustrates a circuit diagram showing a combined structure of a demultiplexer and pixels in which the voltage values of the initialization power supplies are set differently for pixels to adjust a white balance. Except for the initialization power supplies, the organic light emitting display of FIG. 7 is identical to that of FIG. 6. In addition, like reference numerals in FIGS. 6 and 7 refer to like elements.

Referring to FIG. 7, in one embodiment, the red pixel 142R is connected to the first initialization power supply Vint1. The green pixel 142G is connected to the second initialization power supply Vint2. The blue pixel 142B is connected to the third initialization power supply Vint3. In this embodiment, the voltage value of the first initialization power supply Vint1 is set lower than that of the second initialization power supply and higher than that of the third initialization power supply Vint3 to adjust a white balance. Therefore, the first to third initialization power supplies Vint 1 to Vint3 supply different voltages to the red, green, and blue pixels 142R, 142G, and 142B. This arrangement allows display of an image of a satisfactory white balance, and thus improves the overall display quality.

Although various embodiments of the invention have been shown and described, it will be appreciated by those technologists in the art that changes might be made in these embodiments without departing from the principles and spirit of the invention, the scope of which is defined in the claims and their equivalents.

What is claimed is:

1. An organic light emitting display comprising:

a scan driver connected to a plurality of scan lines;

a data driver connected to a plurality of first data lines;

a plurality of sets of second data lines;

a plurality of demultiplexers, each of the demultiplexers being connected at its input to a respective one of the first data lines and at its outputs to a respective one set of the second data lines;

an image display device connected to the scan lines and the second data lines, the image display device having a plurality of pixels, each of the pixels comprising an organic light emitting diode and a first transistor, the first transistor allowing an electric current to flow therethrough to the organic light emitting diode when the first transistor is turned on, the plurality of pixels comprising red pixels, green pixels, and blue pixels;

a common power supply connected to the plurality of pixels, the common power supply being electrically connected to the first transistor of at least one of the pixels when an electric current flows to the organic light emitting diode of the at least one of the pixels;

at least one initialization power supply, selectively connected to the first transistors of the pixels, wherein the initialization power supply is configured to generate three different voltages and to provide one of the three generated voltages to the first transistor of each of the pixels of the image display device, the at least one initialization power supply being electrically disconnected from the first transistors of the pixels when electric currents flow to the organic light emitting diodes of the pixels, the at least one initialization power supply comprising:

a first initialization power supply connected to the red pixels;

a second initialization power supply connected to the green pixels; and a third initialization power supply connected to the blue pixels; and a plurality of data capacitors, each of the data capacitors being coupled with a respective one of the second data lines.

2. The organic light emitting display of claim 1, wherein the voltage of the first initialization power supply is lower than that of the second initialization power supply.

3. The organic light emitting display of claim 2, wherein the voltage of the first initialization power supply is higher than that of the third initialization power supply.

4. The organic light emitting display of claim 1, wherein each of the pixels comprises:

a second transistor coupled between one of the second data lines and one of the scan lines;

a storage capacitor for charging a voltage corresponding to a data signal supplied from the one of the second data lines;

a third transistor for causing the first transistor to be diode-connected; and a fourth transistor coupled with the initialization power supply, wherein the first transistor supplies an electric current corresponding to the voltage charged in the storage capacitor to the organic light emitting diode.

5. The organic light emitting display of claim 4, further comprising at least one fifth transistor coupled with a light emitting control line for controlling a supply time of an electric current flowing from the first transistor to the organic light emitting diode.

6. The organic light emitting display of claim 1, wherein the scan driver supplies a scan signal during a first period that is a part of one horizontal period.

7. The organic light emitting display of claim 6, wherein the data driver supplies a plurality of data signals to the first data line during a second period which does not overlap with the first period of the one horizontal period.

8. The organic light emitting display of claim 7, wherein the demultiplexer comprises a plurality of transistors, each of the transistors being coupled with a respective one of the second data lines.

9. The organic light emitting display of claim 8, wherein the plurality of transistors are sequentially turned-on during the second period to supply the data signal to the data capacitors.

10. The organic light emitting display of claim 9, wherein the voltage stored in the data capacitors is supplied to the red, green, and blue pixels during the first period.

11. The organic light emitting display of claim 1, wherein an electric current provided to the organic light emitting diodes of the pixels decreases as a voltage supplied by the at least one initialization power supply increases.

12. The organic light emitting display of claim 1, wherein each of the pixels further comprises:

a second transistor including a source/drain connected to one of the second data lines, a drain/source connected to a source/drain of the first transistor, and a gate connected to one of the scan lines;

a third transistor including a source/drain connected to a drain/source of the first transistor, a drain/source connected to the gate of the first transistor, and a gate connected to the gate of the second transistor; and a capacitor including a first terminal connected to the common power supply, and a second terminal connected to the gate of the first transistor.

13. The organic light emitting display of claim 12, wherein each of the pixels further comprises:

a fourth transistor including a source/drain connected to the common power supply, a drain/source connected to the drain/source of the first transistor, and a gate; and a fifth transistor including a source/drain connected to the organic light emitting diode, a drain/source connected to the source/drain of the first transistor, and a gate connected to the gate of the fourth transistor.

14. The organic light emitting display of claim 13, wherein each of the pixels further comprises a sixth transistor including a source/drain connected to the at least one initialization power supply, a drain/source connected to the second terminal of the capacitor, and a gate connected to another of the scan lines.

15. The organic light emitting display of claim 14, wherein the sixth transistor is configured to be turned on to initialize the first transistor during a period before the fourth and fifth transistors are turned on.

16. A method of operating the organic light emitting display of claim 14, the method comprising, in sequence:

providing a first scan signal to the other of the scan lines to turn on the sixth transistor of at least one of the pixels for a first time period such that the gates of the red, green, and blue pixels are provided with different voltages;

providing a second scan signal to the one of the scan lines to turn on the second and third transistors of the at least one of the pixels for a second time period; and turning on the fourth and fifth transistors of the at least one of the pixels for a third time period such that an electric current flows to the organic light emitting diode of the at least one of the pixels.

17. An organic light emitting display comprising:

means for providing scan signals to a plurality of scan lines;

means for providing data signals to a plurality of first data lines;

a plurality of sets of second data lines;

a plurality of means for receiving a data signal from a respective one of the first data lines and outputting data signals to a respective one set of the second data lines;

means for displaying an image according to the scan signals from the scan lines and the data signals from the second data lines, the displaying means comprising a plurality of pixels, each of the pixels comprising an organic light emitting diode and a first transistor, the first transistor allowing an electric current to flow therethrough to the organic light emitting diode when the first transistor is turned on;

first power supply means for supplying common power to the means for displaying;

second power supply means for providing a common voltage potential to each of the first transistors of the means for displaying; and third power supply means for generating initialization power supplies of different voltage levels and supplying one of the generated voltages to the first transistor of the means for displaying, wherein the third power supply means is selectively connected to the first transistor, wherein the means for displaying comprises pixels of different colors, and wherein the pixels of different colors are provided with the initialization power supplies of different voltage levels.

18. The organic light emitting display of claim 17, wherein each of the pixels comprises a capacitor, and wherein a voltage level provided to the capacitor by the third power supply means at least partially sets an amount of charge stored in the capacitor.

19. The organic light emitting display of claim 18, wherein the amount of charge stored in the capacitor at least partially sets an amount of current provided to the organic light emitting diode of the pixel.

20. An organic light emitting display comprising:

a plurality of scan lines;

a plurality of data lines;

a plurality of pixels, each of the pixels comprising an organic light emitting diode and first transistor, the first transistor being configured to allow an electric current to flow therethrough to the organic light emitting diode when the transistor is turned on, the plurality of pixels comprising pixels of different colors;

a common power supply connected to the plurality of pixels, the common power supply being electrically connected to the first transistor of at least one of the pixels when an electric current flows to the organic light emitting diode of the at least one of the pixels; and a plurality of initialization power supplies selectively electrically connected to the first transistor of each of the pixels, the plurality of initialization power supplies configured to generate different voltages and to provide one of the generated voltages to the first transistor of each of the pixels, the initialization power supplies being electrically disconnected from the transistors of the pixels when electric currents flow to the organic light emitting diodes of the pixels, wherein the initialization power supplies provide different voltages to the pixels of different colors.

* * * * *